United States Patent [19]

Goloff et al.

[11] 4,169,488

[45] Oct. 2, 1979

[54] COOLED ENGINE VALVE

[75] Inventors: Alexander Goloff, East Peoria; Richard A. Cemenska, Edelstein, both of Ill.

[73] Assignee: Caterpillar Tractor Co., Peoria, Ill.

[21] Appl. No.: 854,188

[22] Filed: Nov. 23, 1977

[51] Int. Cl.[2] ..... F01P 3/14; F16K 49/00; F01L 3/14; F01L 3/18

[52] U.S. Cl. ..... 137/340; 123/41.34; 123/41.41; 123/188 AA; 123/188 GC

[58] Field of Search ..... 123/41.34, 41.41, 188 A, 123/188 AA, 188 GC; 137/340

[56] References Cited

U.S. PATENT DOCUMENTS

| | | | |
|---|---|---|---|
| 1,068,830 | 7/1913 | Westaway | 123/188 A |
| 1,353,542 | 9/1920 | Scharnagel | 123/188 A |
| 1,594,285 | 7/1926 | Watts | 123/188 GC |
| 2,411,734 | 11/1946 | Kerwin et al. | 123/188 A |

FOREIGN PATENT DOCUMENTS

| | | | |
|---|---|---|---|
| 255028 | 12/1927 | United Kingdom | 123/41.41 |
| 1438740 | 6/1976 | United Kingdom | 123/41.41 |

*Primary Examiner*—Charles J. Myhre
*Assistant Examiner*—Jeffrey L. Yates
*Attorney, Agent, or Firm*—Phillips, Moore, Weissenberger, Lempio & Majestic

[57] ABSTRACT

An engine valve, reciprocally mounted in an engine, comprises a hollow stem having a head secured thereon and an annular face defined on the head adapted to engage an annular seat defined on an insert secured in the engine. A first tube is disposed in the stem to define a first passage therethrough and a fluted second tube is disposed between the stem and the first tube to define a plurality of second passages therethrough. A lower end of the first tube is open whereas a lower end of the second tube is closed by a cap whereby a coolant, such as oil, may be circulated through the first and second passages. A plurality of third passages are defined between the second tube and the stem to communicate with a chamber defined in the head of the valve, adapted to contain a vaporizable liquid coolant, such as water, therein. The insert has an annular passage defined therearound for circulating water about the seat and face for cooling purposes.

16 Claims, 5 Drawing Figures

Fig-1-
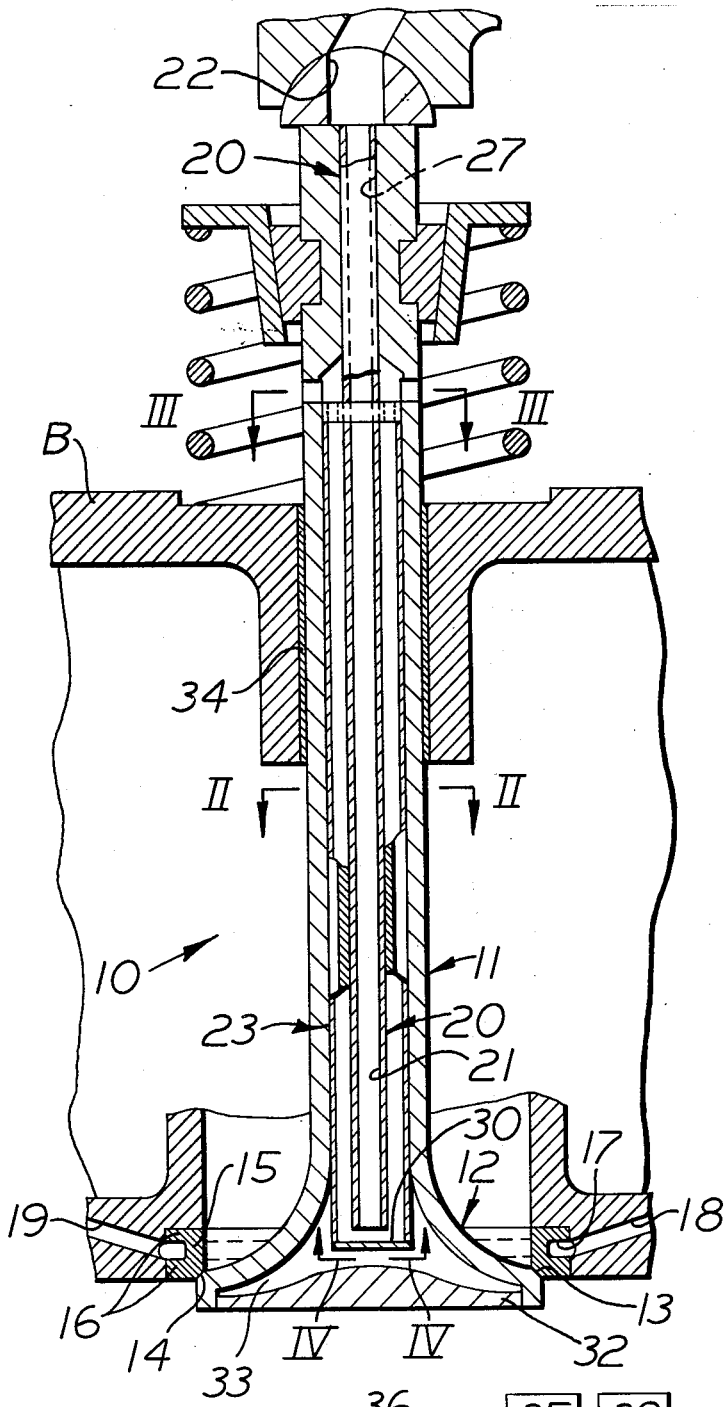
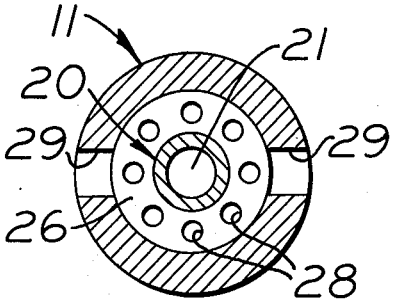
Fig-3-
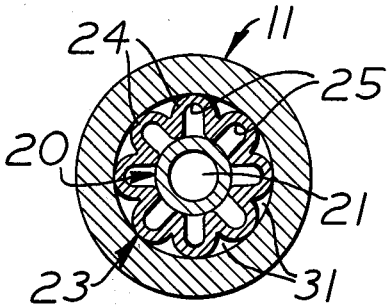
Fig-2-
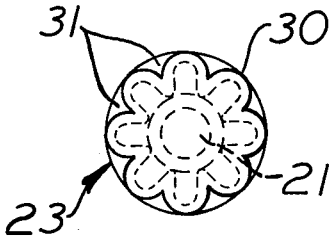
Fig-4-
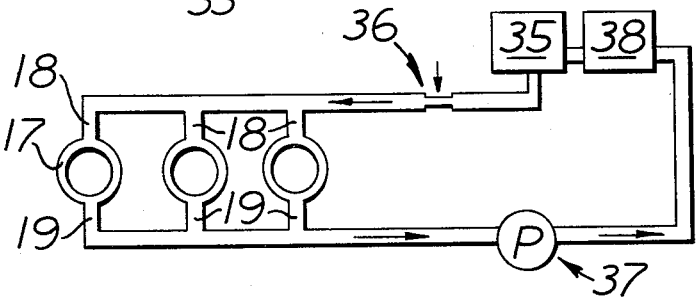
Fig-5-

COOLED ENGINE VALVE

BACKGROUND OF THE INVENTION

This invention relates to a cooling arrangement for an internal combustion engine comprising an oil-cooled valve reciprocally mounted therein.

Diesel engines operating on high sulfur fuels, oftentimes containing vanadium compounds, periodically require "top end overhauls" or grinding of the exhaust valves and seats employed therein due to corrosion effects and exposure to high heat levels. Such corrosion tends to induce a "channeling" or "guttering" of the valve faces to accelerate such corrosion and to give rise to gas leakage past the valves and potential breakage of the valve heads. Corrosion also occurs on the top of the valve heads, tending to cause severe pitting which may also lead to valve head failures. A similar corrosion problem may be experienced at the valve seats should they become exposed to abnormally high temperatures and depending upon their metallurgical make-up.

Metallurgical solutions have not fully solved the corrosion problem due to the high temperature levels experienced by the valves during engine operation. Therefore, the state-of-the-art has made various attempts to cool the exhaust valves by packing them with metallic sodium or other suitable cooling medium, by circulating oil through the valves or by circulating water circumferentially about the valve seats. The former attempt has a tendency, for example, to raise the temperature level of the valve stems to thus reduce the service life of the tubular guides reciprocally mounting the valves in an engine.

Also, circulation of water about the valve seats or the circulation of oil through the valves for cooling purposes has not provided a final solution to the corrosion problem. Examples of such oil-cooled valves are disclosed in U.S. Pat. Nos. 3,911,875 and 3,945,356. Another problem encountered with valves of this type is a loss of structural integrity in the composite valve due to the various passages and tubes disposed therein for oil circulation purposes. A high structural integrity of the valve is required, particularly since it may vibrate during engine operation and may impact its seat with considerable force.

SUMMARY OF THE INVENTION

The present invention is directed to overcoming one or more of the problems as set forth above.

In one aspect of this invention, a valve comprises an elongated hollow stem having a head secured thereon to define an annular face. Circulation means, disposed within the valve, circulates a first coolant, such as oil, therethrough. The circulation means comprises first tube means defining first passage means therethrough and fluted second tube means disposed between the first tube means and the stem of the valve to define second passage means between the first and second tube means, communicating with the first passage means. Closed passage means, defined between the stem and second tube means and disposed in heat exchange relationship relative to the circulation means, retains a second coolant, such as water, therein for transferring heat to the first coolant. This combination thus provides for efficient cooling and reduces corrosion at the critical areas adjacent to the face of the valve which are subjected to relatively high heat levels. The valve is also provided with a high degree of structural integrity.

In another aspect of this invention, an upper end of the first tube means forms an inlet to the first passage means, an outlet port is formed through a sidewall of the stem, a separate annular member is secured in the stem, adjacent to the outlet port, and has the first tube means extending therethrough, and a plurality of ports are formed through the member to communicate the second passage means with the outlet port.

BRIEF DESCRIPTION OF THE DRAWING

Other objects of this invention will become apparent from the following description and accompanying drawing wherein:

FIG. 1 is a longitudinal sectional view of a valve embodying this invention, reciprocally mounted on an engine cylinder head;

FIGS. 2 and 3 are sectional views through the valve, taken in the direction of arrows II—II and III—III, respectively in FIG. 1;

FIG. 4 is a bottom plan view of a closed tube employed in an oil circulation system for the valve; and FIG. 5 schematically illustrates a cooling system for valve seats mounted in the engine.

DETAILED DESCRIPTION

FIG. 1 illustrates a valve 10 reciprocally mounted in an engine's cylinder head H in a conventional manner. The valve comprises an elongated and hollow stem 11 having a hollow head 12 secured to a lower end thereof. The head has an annular face 13 formed thereon adapted to engage a like-formed seat 14, formed on an insert mounted on the engine block.

The insert comprises an annular strut 15 and a pair of vertically spaced radial flanges 16, defining an annular passage or groove 17 circumferentially therein and adapted for integration into a hereinafter described cooling system, including inlet and outlet passages 18 and 19, respectively. In general, water or other suitable engine coolant may be circulated in close proximity (preferably within three-tenths of an inch) to face 13 and seat 14 to dissipate heat therefrom. Although the hereinafter described valve is particularly adapted for use as an exhaust valve, since the corrosion and heat problems are of particular concern therewith, it should be understood that the inlet valves for the engine could be constructed in a like manner.

A first tube means 20 is disposed centrally in stem 11 and has a first passage means 21 defined therein. As more fully described hereinafter, crankcase oil, preferably constituting a first coolant, may be suitably communicated to such passage means via an inlet 22. The inlet may be suitably formed in a standard "elephant's foot" type of button continuously maintained in bearing contact with the top end of the valve stem by a hydraulic lifter, spring clip or the like.

As shown in FIG. 2, a second tube means 23 is fluted to comprise a plurality of longitudinally extending and circumferentially disposed flutes 24 which may have straight or helical configurations. Each flute defines an elongated passage 25 of a second passage means therethrough. The outer sides of the flutes may be brazed or otherwise suitably secured to stem 11 whereas the inner sides thereof may be suitably secured in a like manner to the periphery of tube means 20, if so desired.

Thus, the first and second passage means, defined by tube means 20 and 23, are isolated from each other during circulation of a first coolant therethrough. In addition, this integrated valve construction exhibits a high degree of structural integrity since first tube means 20 is securely held in position by second tube means 23 whereas the second tube means engages stem 11 in bearing contact therewith substantially throughout its length and circumferentially therearound. Thus, vibrations imparted to the valve or the tube means during operation thereof will be substantially dampened to increase the service life thereof over conventional, hollow valves.

Referring to FIG. 3, an upper end of tube means 23 is secured to an underside of an annular member 26. Tube means 20 extends upwardly through the member and through a bore 27, having a smaller diameter than the inside diameter of stem 11 proper. A plurality of circumferentially spaced ports 28 are formed through the member to each communicate with a respective passage 25. The member thus isolates the first and second passage means from each other.

A pair of diametrically opposed ports 29 are formed through the sidewall of stem 11 to communicate with ports 28 and thus passages 25 of the second passage means. As will be hereinafter more fully understood, although passage means 21 preferably comprises an inlet passage and passages 25 of the second passage means preferably comprise outlet passages, that the flow pattern could be reversed so that passages 25 constitute inlet passages whereas passage means 21 constitutes an outlet passage.

Referring to FIGS. 1 and 4, it should be noted that the lower end of first tube means 20 preferably terminates short of second tube means 23. A lower end of second tube means 23 is closed by a star-shaped cap 30 suitably secured thereto. Thus, the first and second passage means define circulation means for continuously circulating oil through the valve during engine operation.

Referring once again to FIG. 2, a plurality of elongated and circumferentially disposed passages 31 are defined between second tube means 23 and stem 11 to provide closed third passage means in the valve disposed in heat exchange relationship with passages 25. An annular cap 32, secured to head 12 to form an integral part thereof, defines a chamber 33 in the hollow head communicating with passages 31. The chamber may be filled with a suitable second coolant, such as water which may have a corrosion inhibitor or an antifreeze mixed therein, upon fabrication of the valve to aid in cooling the valve and, particularly, face 13 thereof. Other types of fluidized coolants could also be employed, so long as they will vaporize in the manner and for the purpose described herein.

In operation, reciprocation of valve 10 will function to alternately open and close the valve to communicate gases to the exhaust manifold in a conventional manner. Such exhaust gases subject face 13 and seat 17 to corrosion due to the intense heat generated thereby, particularly when the fuel employed in the engine is laden with sulfur and vanadium. Continuous circulation of crankcase oil from inlet 22, through passage means 21 and passages 25 and back to the engine's crankcase via outlet ports 29 functions to dissipate such heat to alleviate the corrosion problem.

The second coolant, such as water, contained in closed passages 31 and chamber 33 aids in such dissipation of heat from the critical areas of the valve, adjacent to face 13. It should be noted in FIG. 2 that passages 31 are disposed in heat exchange relationship with respect to passages 25 to provide a substantial surface area therebetween whereby the cooling effects on the valve are greatly increased by conducting heat through tube means 23 and thus to the oil "heat sink" circulating through passages 25. In addition to cooling face 13, other critical areas of the valve are also effectively cooled, including the top of valve head 12, the underhead radius of the head and stem 11.

The water contained in chamber 33 will boil and vaporize to create steam in passages 31 during valve operation. The steam thereafter condenses in the area of passages 31 and is automatically replaced by newly created steam. The water is subjected to violent shaking by the reciprocating action of the valve to thus cool the valve not only by means of nucleate boiling, but also by the "cocktail shaker" action of the valve.

The limitation on the amount of heat transferred in any heat pipe is primarily dependent on the ability to condense steam; for example, at reasonable temperatures and pressures. In the heat exchanger arrangement described above, as steam condenses within passages 31 in stem 11, it is automatically replaced by newly formed steam. The amount of heat conducted through the substantial heat-conducting surface area of tube means 23 to the oil circulating in passages 25 automatically controls the steam pressure and temperature. As suggested above, flutes 24 may have straight or helical configurations, the latter providing a larger heat-conducting surface area on tube means 23.

The above cooling not only prolongs the service life of the valve and seat 14, but also advantageously provides that close clearances may be maintained between stem 11 and a valve guide 34, secured in the engine block. Such close clearances (e.g., 0.0005 to 0.0015 in.) are made possible since stem 11 is maintained at approximately the same temperature as the valve guide itself. Thus, no appreciable differential expansion occurs therebetween.

The maintenance of such close clearances between the valve stem and guide will resist any leakage of oil therebetween and will result in substantially less wear than valve arrangements employing clearances four to five times the amount of clearance specified above. Therefore, in addition to increasing the service life of the valve, the service life of the valve guide is also increased. Furthermore and as suggested above, the structural integrity of valve 10 is substantially increased over conventional ones since tube means 20 and 23 afford substantial lateral support to valve stem 11 and the heat exchanger. The increased structural integrity of the valve thus aids in dampening vibrations imparted to the valve and the tube means during operation thereof.

As briefly discussed above, another feature of this invention resides in the combination of groove means 17 for circulating water or other suitable coolant circumferentially around seat 14 and means for cooling valve 10 independently. For example, the latter means may comprise tube means 20 and 23 for circulating crankcase oil through the valve, chamber 33 for containing another coolant therein or a combination thereof.

In particular, such combination is adapted to cool the valve and seat 14 to such an extent that other variables tending to corrosively attack the valve and seat become less important. For example, such variables may include any distortion of valve seat 14, any distortion of the cylinder head, the load imposed on the engine, the exhaust temperature, valve guide clearance, the type of oil utilized and its state of deterioration, the salt content of the air-fuel mixture employed in the engine, the sulfur and vanadium content of the fuel, and, to some extent, valve metallurgy.

The interaction between the temperatures of valve 10 and seat 14 will constitute the most significant interaction between any of the above-mentioned variables which tend to give rise to the corrosion problem. To date, the state-of-the-art has apparently failed to recognize such interaction as constituting the most critical factors for combating the corrosion problem. FIG. 5 illustrates a cooling system for circulating water or other suitable liquid first coolant through each annular groove 17 whereby the cooling effects thereat will cooperate with the cooling means and second coolant provided in valve 10 proper to independently but simultaneously substantially reduce the overall operating temperature of the valve.

The cooling system comprises a tank 35 communicating with groove 17 via a standard variable restriction 36 to preferably maintain the pressure of the water in the grooves below atmospheric pressure. A positive displacement or centrifugal-type pump 37 returns the water back to tank 35 via a heat exchanger 38 for reducing the temperature level of the water. The speed of the pump may be controlled to maintain the pressure of the water in grooves 17 below atmospheric pressure by itself or in conjunction with restriction 36. The reduction of water pressure in the grooves functions to reduce the heat saturation temperature of the water below 212° F. For example, at 5 psia the saturation temperature of water approximates only 162° F.

The FIG. 5 cooling system may be independent of the standard cooling system, including the jacket means illustrated in FIG. 1 for circulating a third coolant such as water therethrough, for maintaining a substantially lower temperature level of the first coolant circulated through grooves 17. For example, the coolant circulated through the jacket means may be maintained at a temperature level approximately 200° F. whereas the coolant circulated through the grooves may be maintained at approximately 160° F.

Referring again to FIG. 1, the insert is preferably brazed to the engine's cylinder head H to prevent leakage of water into the combustion chamber. Since the insert is subjected to substantial mechanical loading, strut 15 has a substantially large wall thickness for load carrying purposes. Radial flanges 16, secured to the engine block, fully support the strut and permit seat 14 to be formed on the insert to close proximity to groove 17, i.e., no more than three-tenths of an inch from the seat.

The embodiments of the invention in which an exclusive property or privilege is claimed are defined as follows:

1. A valve comprising an elongated hollow stem, a head secured to an end of said stem and defining an annular face thereon, circulation means disposed in said valve for circulating a first coolant therethrough, said circulation means comprising first tube means disposed in said stem to define first passage means therethrough and second tube means disposed radially between said first tube means and said stem in substantial coextensive relationship therewith to define second passage means between said first and second tube means communicating with said first passage means whereby said first coolant may be circulated through said first and second passage means, and closed passage means disposed in heat exchange relationship relative to said circulation means for retaining a second coolant therein for transferring heat to said first coolant, said second tube means being fluted to comprise a plurality of circumferentially disposed flutes secured radially between said stem and said first tube means and wherein said closed passage means comprises a plurality of elongated and circumferentially disposed passages defined by said flutes radially between said second tube means and said stem and disposed in heat exchange relationship relative to said second passage means.

2. The valve of claim 1 wherein said head is hollow to define a chamber therein, said chamber communicating with said closed passage means and extending radially outwardly in close proximity to said face.

3. The valve of claim 2 wherein said second coolant constitutes a vaporizable liquid which will vaporize at a predetermined temperature when heat is added thereto and which will condense when such heat is withdrawn therefrom.

4. The valve of claim 3 wherein said second coolant comprises water.

5. The valve of claim 1 wherein said head is hollow to define a chamber therein communicating with said closed passage means, said chamber extending radially outwardly in close proximity to said face.

6. The valve of claim 1 wherein a lower end of said second tube means has a cap secured thereon to close said second passage means.

7. The valve of claim 6 wherein a lower end of said first tube means is open, terminates short of said second tube means and is spaced longitudinally from said cap whereby said first and second passage means communicate with each other thereat.

8. The valve of claim 1 wherein said head comprises an annular cap secured on an end thereof to define a chamber in said head communicating with said closed passage means.

9. The valve of claim 1 wherein an upper end of said first tube means is disposed centrally of said stem to form an inlet to said first passage means and further comprising at least one outlet port formed through a sidewall of said stem communicating with said second passage means to form an outlet therefrom.

10. The valve of claim 9 further comprising an annular member secured in said stem, adjacent to said port, said first tube means extending through said member and a plurality of radially and circumferentially disposed ports formed through said member and communicating with said second passage means.

11. The valve of claim 10 wherein an upper end of said second tube means is secured to said member.

12. A valve comprising an elongated hollow stem, a head secured to an end of said stem and defining an annular face thereon, first tube means disposed in said stem to define first passage means therethrough, an upper end of said first tube means being disposed centrally of said stem to form an inlet to said first passage means, second tube means disposed between said first tube means and said stem to define second passage means therethrough communicating with said first passage means whereby a coolant may be circulated through said first and second passage means to cool said valve, at least one outlet port formed through a sidewall of said stem communicating with said second passage means to form an outlet therefrom, a separate annular member secured to said stem, adjacent to said outlet port, said first tube means extending through said member, and a plurality of circumferentially disposed ports formed through said member and communicating said second passage means with said outlet port, an upper end of said second tube means terminating at said member.

13. The valve of claim 12 wherein said first and second tube means are each disposed in said stem to terminate in said head and wherein said first tube means is open at a lower end thereof and wherein said second tube means has a cap secured to a lower end thereof to close said second passage means.

14. The valve of claim 12 further comprising a plurality of elongated and circumferentially disposed third passage means defined between said second tube means and said stem and disposed in heat exchange relationship relative to said second passage means.

15. The valve of claim 14 wherein said stem is hollow to define a chamber therein communicating with said third passage means, said chamber extending radially outwardly in close proximity to said face and adapted to retain a vaporizable coolant therein.

16. The valve of claim 12 wherein said second tube means is fluted to comprise a plurality of circumferentially disposed flutes each defining an elongated passage of said second passage means therethrough.

* * * * *

UNITED STATES PATENT OFFICE

CERTIFICATE OF CORRECTION

Patent No. 4,169,488 Dated October 2, 1979

Inventor(s) Alexander Goloff, et al.

It is certified that error appears in the above-identified patent and that said Letters Patent are hereby corrected as shown below:

Please delete "Richard A. Cemenska" as joint inventor.

Signed and Sealed this

*Seventeenth* Day of *June 1980*

[SEAL]

*Attest:*

SIDNEY A. DIAMOND

*Attesting Officer* *Commissioner of Patents and Trademarks*